US012310492B2

(12) United States Patent
Shinozaki

(10) Patent No.: US 12,310,492 B2
(45) Date of Patent: May 27, 2025

(54) RACK ASSEMBLY WITH ADJUSTABLE INSTALLATION HEIGHT OF BEAM MEMBER

(71) Applicant: KAWAJUN CO., LTD., Tokyo (JP)

(72) Inventor: Takashi Shinozaki, Tokyo (JP)

(73) Assignee: KAWAJUN CO., LTD., Tokyo (JP)

( * ) Notice: Subject to any disclaimer, the term of this patent is extended or adjusted under 35 U.S.C. 154(b) by 0 days.

(21) Appl. No.: 18/287,138

(22) PCT Filed: Aug. 18, 2023

(86) PCT No.: PCT/JP2023/029780
§ 371 (c)(1),
(2) Date: Oct. 16, 2023

(87) PCT Pub. No.: WO2025/022673
PCT Pub. Date: Jan. 30, 2025

(65) Prior Publication Data

US 2025/0072599 A1 Mar. 6, 2025

(30) Foreign Application Priority Data

Jul. 21, 2023 (JP) ..... 2023-119217

(51) Int. Cl.
*A47B 57/34* (2006.01)
*A47B 47/00* (2006.01)
*A47B 47/02* (2006.01)

(52) U.S. Cl.
CPC ..... *A47B 57/34* (2013.01); *A47B 47/0083* (2013.01); *A47B 47/027* (2013.01)

(58) Field of Classification Search
CPC ..... A74B 57/34; A74B 57/32; A74B 57/48; A74B 57/545; A74B 57/54;
(Continued)

(56) References Cited

U.S. PATENT DOCUMENTS 2,872,144 A * 2/1959 Hobson ..... A47B 57/32 248/225.11
3,273,720 A * 9/1966 Seiz ..... A47B 57/402 108/107

(Continued)

FOREIGN PATENT DOCUMENTS

CA 2164463 A * 6/1996 ..... A47B 47/04
EP 0 686 817 A2 12/1995

(Continued)

OTHER PUBLICATIONS

International Search Report dated Oct. 3, 2023, issued in counterpart International Application No. PCT/JP2023/029780. (3 pages).

(Continued)

*Primary Examiner* — Jennifer E. Novosad
(74) *Attorney, Agent, or Firm* — WHDA, LLP

(57) ABSTRACT

A rack assembly includes a column member including a first side surface that includes a plurality of recessed portions provided at a regular interval in an axial direction, and a second side surface that is adjacent to the first side surface, and a beam member including a first part that includes a protruding portion and that faces the first side surface, and a second part that is provided adjacent to the first part and that faces the second side surface, where each of the plurality of recessed portions extends in a normal direction of the second side surface, and the beam member is movable between a first position at which the second part faces the second side surface in a state where the beam member is separated from the column member, and a second position at which the beam member is fixed to the column member.

5 Claims, 16 Drawing Sheets

(58) Field of Classification Search
CPC ..... A74B 96/1441; A74B 96/1475; A74B 2096/1491; A47B 47/0083; A47B 47/027
USPC ..... 211/187, 191, 192; 248/218.4, 219.4
See application file for complete search history.

(56) References Cited

U.S. PATENT DOCUMENTS 3,352,584 A * 11/1967 Engel ..... A47B 57/402 211/192
4,285,436 A * 8/1981 Konstant ..... A47B 57/482 211/192
4,648,517 A * 3/1987 Schafer ..... F16B 7/22 108/162
4,708,252 A * 11/1987 Azzi ..... A47B 57/402 52/646
5,174,200 A * 12/1992 Jeandel ..... A47B 57/36 108/193
5,941,399 A * 8/1999 Wang ..... A47B 57/54 211/187
6,273,281 B1 * 8/2001 Berglund ..... A47B 57/50 108/147.11
7,191,908 B2 * 3/2007 De Rijk ..... A47B 57/48 211/208
8,118,181 B2 * 2/2012 Shinozaki ..... A47B 47/0083 211/208
8,627,966 B2 * 1/2014 Jarvis ..... A47B 57/545 211/187
10,441,074 B2 * 10/2019 Dahatonde ..... A47B 96/1441
2002/0195029 A1 * 12/2002 Walton ..... A47B 46/00 108/110
2005/0139562 A1 * 6/2005 Chen ..... A47B 57/545 211/187
2021/0361066 A1 * 11/2021 Baez ..... A47B 57/545

FOREIGN PATENT DOCUMENTS

JP 53-129521 U 10/1978
JP 2000-50971 A 2/2000
JP 2002-51846 A 2/2002
JP 3137636 U 12/2007
WO 03/011075 A1 2/2003

OTHER PUBLICATIONS

Written Opinion of the International Searching Authority (Form PCT/ISA/237) dated Oct. 3, 2023, issued in counterpart International Application No. PCT/JP2023/029780. (3 pages).
Office Action for priority dated Sep. 26, 2023, issued in counterpart of Japanese Patent Application No. 2023-119217, with English Translation. (7 pages).

* cited by examiner

RACK ASSEMBLY WITH ADJUSTABLE INSTALLATION HEIGHT OF BEAM MEMBER

TECHNICAL FIELD

The present invention relates to a rack assembly that can be assembled/disassembled.

BACKGROUND ART

For example, there is known a rack assembly (for example, see Patent Literature 1). The rack assembly includes a columnar member, and a crosspiece member that is attached to the columnar member. With the rack assembly, a pair of protrusions are formed on the columnar member. The protrusion includes a pair of protrusions, and a pair of sloping surfaces formed on inner side surfaces of the pair of protrusions. The pair of sloping surfaces are capable of positioning the crosspiece member to the columnar member in both a long direction of the rack and a short direction intersecting the long direction of the rack.

CITATION LIST

Patent Literature

[Patent Literature 1] EP 0686817 A2

DISCLOSURE OF INVENTION

Technical Problem

With the rack assembly, the pair of protrusions serve to perform both positioning of the crosspiece member in the long direction and positioning of the crosspiece member in the short direction, and thus, the pair of protrusions have to be strong to some extent. Accordingly, the pair of protrusions have to be large to some extent. However, when the pair of protrusions are formed to have a certain largeness, there is a problem that degree of freedom is reduced in relation to an installation height of the crosspiece member, and that the installation height of the crosspiece member can be adjusted only at a relatively large pitch. Moreover, when the pair of protrusions are formed to have a certain largeness, there is a problem that the crosspiece member and the pair of protrusions may collide into each other at the time of changing the installation height of the crosspiece member, thereby making it difficult to change the installation height of the crosspiece member.

Accordingly, an object of the present invention is to provide a rack assembly that allows an installation height of a beam member to be more finely adjusted, and that allows the installation height of the beam member to be very easily changed.

Solution to Problem

The problems described above are solved by the present invention described below. That is, a rack assembly of the present invention (1) includes: a column member including a first side surface that includes a plurality of recessed portions provided at a regular interval in an axial direction, and a second side surface that is adjacent to the first side surface; and a beam member including a first part that includes a protruding portion and that faces the first side surface, and a second part that is provided adjacent to the first part and that faces the second side surface, where each of the plurality of recessed portions extends in a normal direction of the second side surface, and the beam member is movable between a first position at which the second part faces the second side surface in a state where the beam member is separated from the column member, and a second position at which the beam member is fixed to the column member by being moved in the normal direction of the second side surface from the first position and by having the protruding portion inserted into one of the plurality of recessed portions.

Furthermore, a rack assembly of the present invention (2) is the rack assembly according to (1), where the first side surface includes a plurality of second recessed portions, each of the plurality of second recessed portions extending downward from a deep part of each of the plurality of recessed portions, and the protruding portion is allowed to be fitted down in the second recessed portion at the second position to allow the beam member to move from the second position to a third position lower than the second position.

Furthermore, a rack assembly of the present invention (3) is the rack assembly according to (2), where

- the column member includes a rail that protrudes from the second side surface and extends in the axial direction, and
- the second part includes a saddle part extending in the axial direction and having a saddle shape that allows mounting on the rail, the saddle part being capable of sliding and moving along the rail at a time when the beam member is moved between the second position and the third position.

Furthermore, a rack assembly of the present invention (4) is the rack assembly according to (3), where

- the first side surface includes a protrusion at a position surrounded by the recessed portion and the second recessed portion, and
- when the beam member is at the third position, the protruding portion fitted down in the second recessed portion engages with the protrusion.

Furthermore, a rack assembly of the present invention (5) is the rack assembly according to (3) or (4), where the rail includes a top surface, a first guiding surface provided adjacent to the top surface, on a side of the first side surface, and a second guiding surface provided adjacent to the top surface in a manner facing the first guiding surface, the second guiding surface being sloped away from the first side surface, the closer to a bottom.

Furthermore, a rack assembly of the present invention (6) is the rack assembly according to (5), where the saddle part includes a guided surface that is guided by the second guiding surface, the guided surface being sloped to be closer to the rail, the closer to a top.

Furthermore, a rack assembly of the present invention (7) is the rack assembly according to (5) or (6), where

- the beam member includes a beam main body that extends in a normal direction of the first side surface, and
- the normal direction of the first side surface matches a long direction.

Furthermore, a rack assembly of the present invention (8) is the rack assembly according to (1) to (7), where the column member includes, at a position facing the first side surface and adjacent to the second side surface, a first side surface that is additionally provided.

Advantageous Effects of Invention

According to the present invention, there can be provided a rack assembly that allows an installation height of a beam member to be finely adjusted, and that allows the installation height of the beam member to be very easily changed.

DESCRIPTION OF EMBODIMENT

Hereinafter, an embodiment of a rack assembly of the present invention will be described with reference to the drawings. The rack assembly of the present invention includes a very small number of parts, and can be easily assembled/disassembled. Furthermore, an installation height of a beam member can be finely adjusted, and protrusions and recesses have simple shapes and can be easily cleaned. In the following, a description will be given by taking a long direction of the rack assembly as L, a short direction intersecting (orthogonal to) the long direction L of the rack assembly as S, and a height direction of the rack assembly (an axial direction of a column member) as A.

First Embodiment

Figure 1:
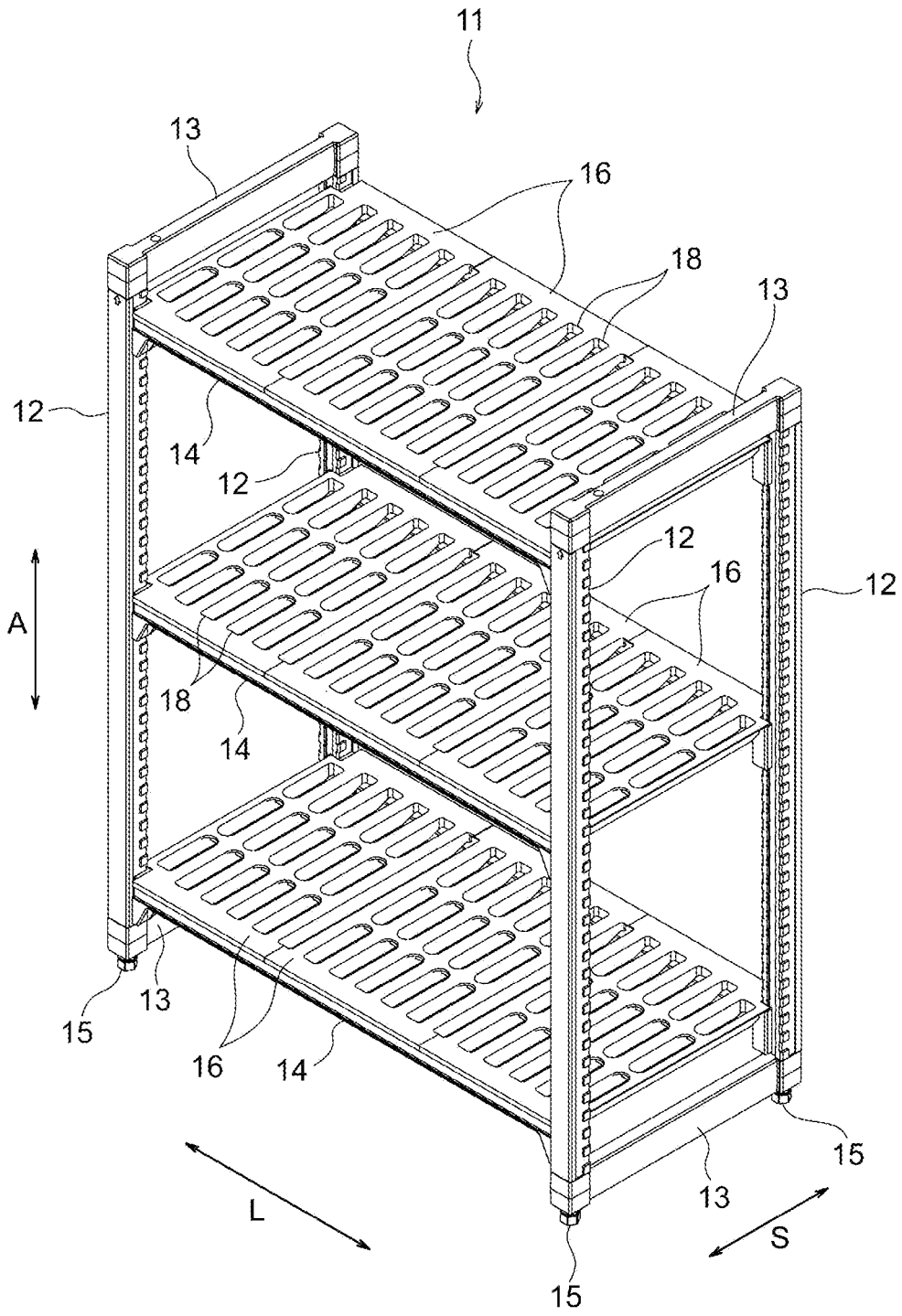
FIG. 1 is a perspective view showing a rack assembly of an embodiment.
Figure 2:
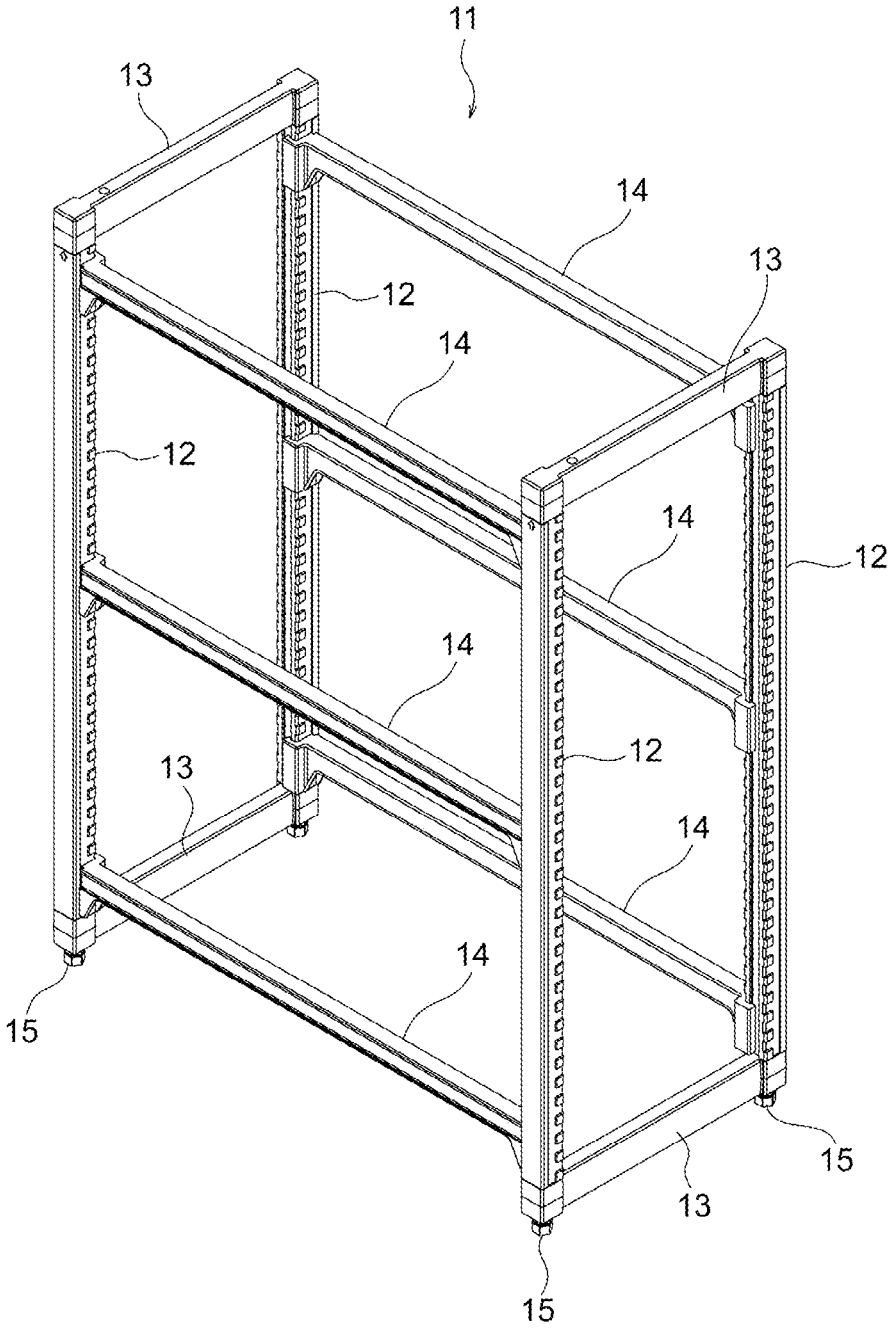
FIG. 2 is a perspective view showing a state where shelf panels are removed from the rack assembly shown in FIG. 1.
Figure 3:
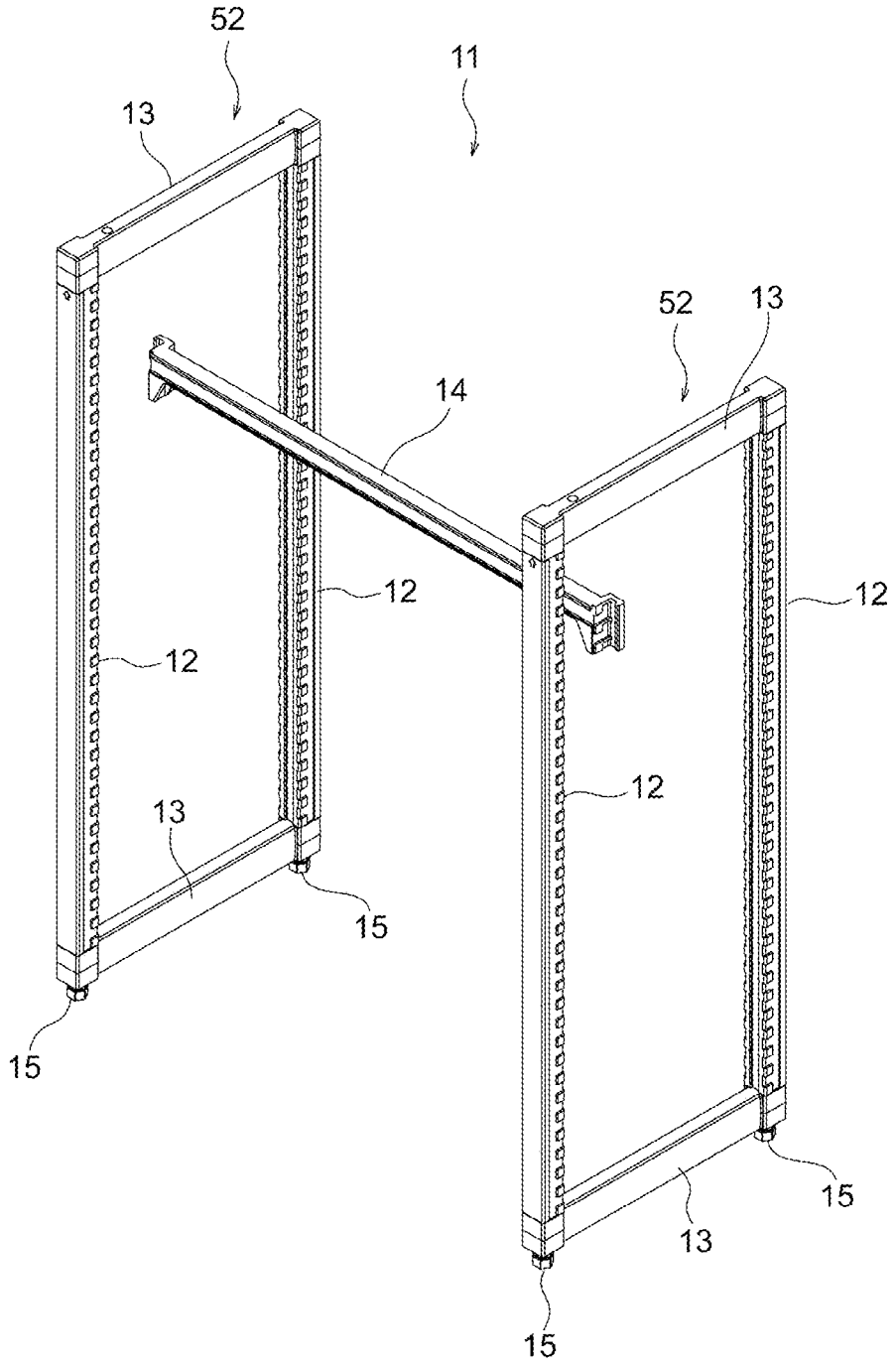
FIG. 3 is a perspective view showing a state where a beam member is detached into air from the rack assembly shown in FIG. 2.

As shown in FIGS. 1 to 3, a rack assembly 11 includes a total of four column members 12 that are provided at four corner portions, a plurality of rod-shaped coupling pieces 13 that are provided along the short direction S and that couple the column members 12, a plurality of beam members 14 that extend in a lateral direction to be provided between the column members 12 along the long direction L, leg parts 15 that are provided at lower ends of the coupling pieces 13, and a shelf panel 16 that is placed between a pair of beam members 14.

Figure 15:
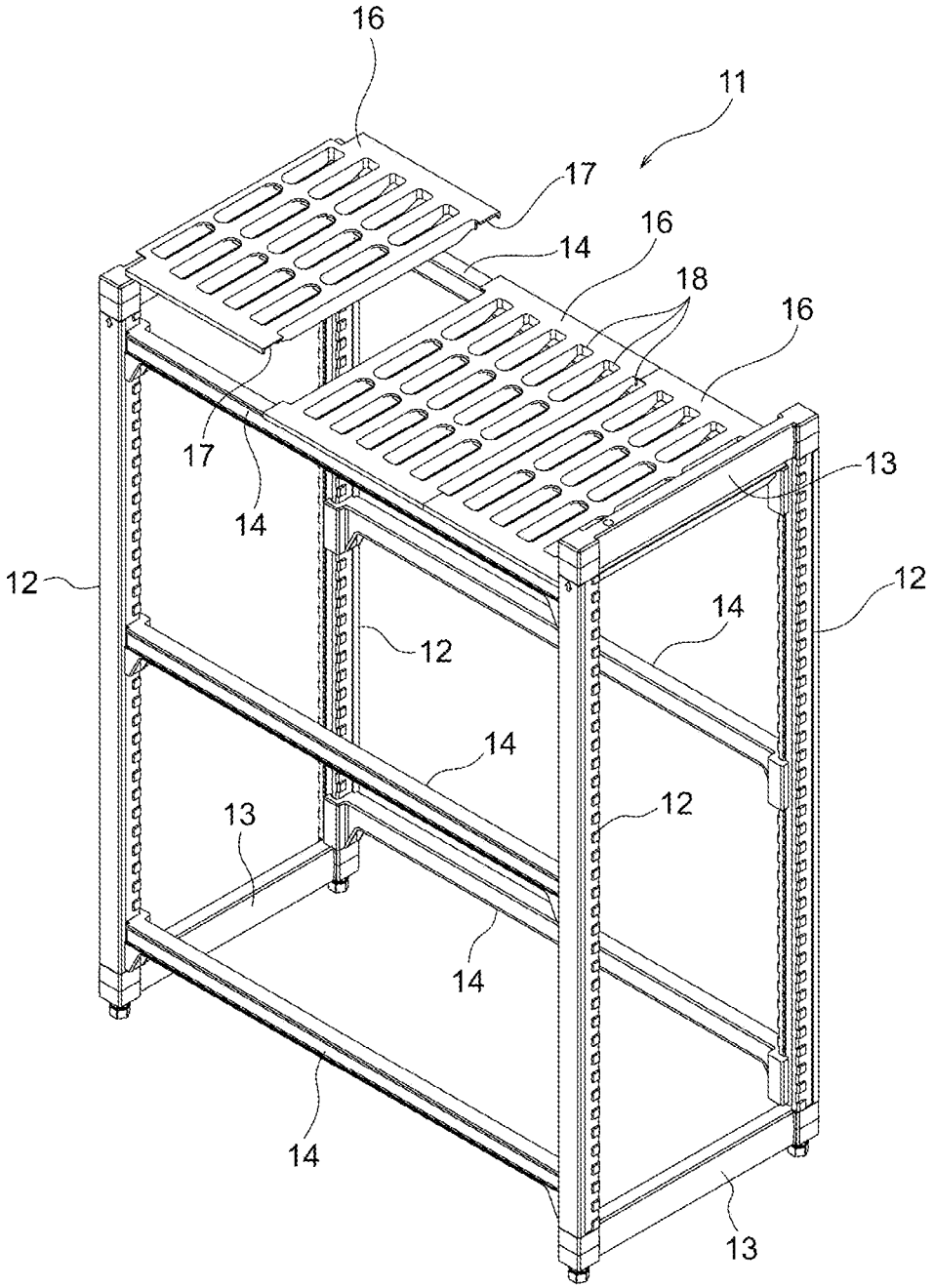
FIG. 15 is a perspective view showing, in relation to the rack assembly shown in FIG. 2, a state where a shelf body is being installed.

As shown in FIGS. 1 and 15, the shelf panel 16 includes, at both end portions in the short direction S, a pair of hook portions 17 that are hooked to the pair of beam members 14. The shelf panel 16 includes a plurality of through holes 18. The through hole 18 is formed to be long and narrow in the short direction S, for example.

The coupling pieces 13 are provided at upper ends of the column members 12, and at lower ends of the column members 12. The coupling pieces 13 are formed to have a same form. The coupling pieces 13 extend in the lateral direction (horizontal direction).

Figure 4:
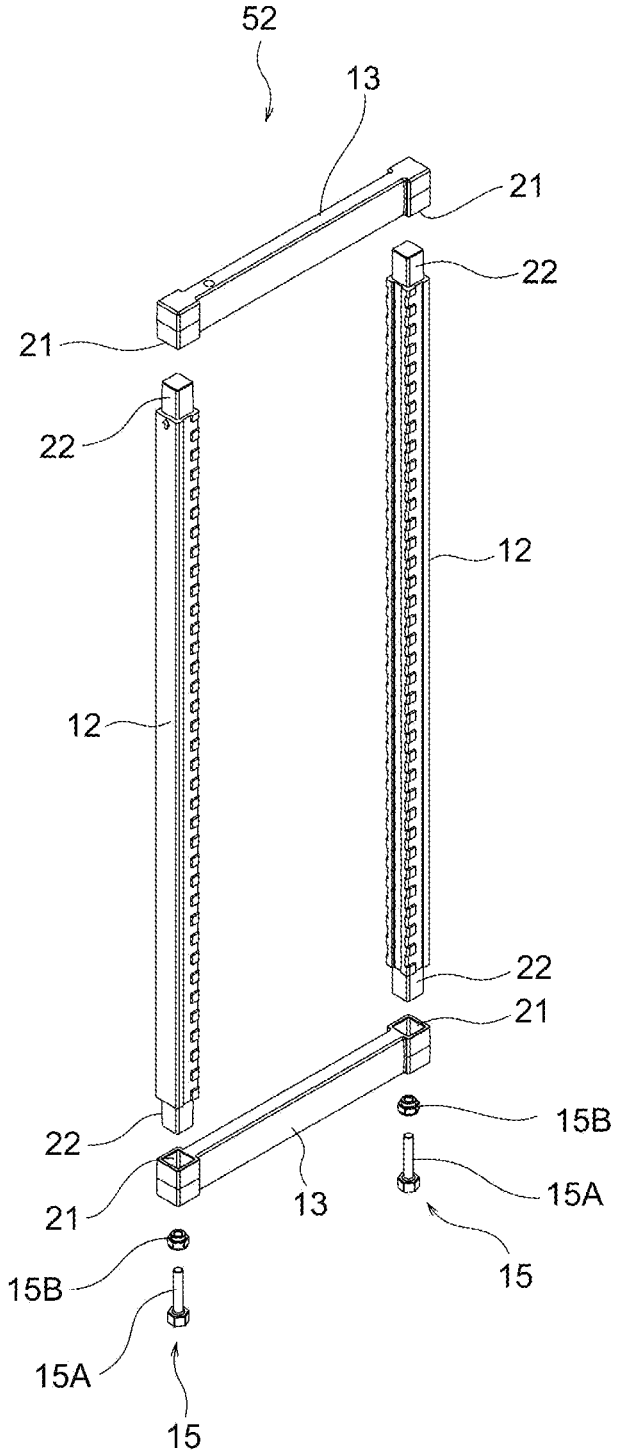
FIG. 4 is an exploded perspective view showing, in a disassembled manner, a frame of the rack assembly shown in FIG. 3.

As shown in FIGS. 3 and 4, each coupling piece 13 is formed as a rectangular columnar shape that has a vertically long, rectangular cross-section, and includes a pair of insertion holes 21 at both end portions. The column members 12 may be easily coupled to each other by inserting insertion parts 22 into the insertion holes 21, the insertion parts 22 being provided at both end portions of each column member 12 and having rectangular columnar shape. The coupling piece 13 is integrally formed by a resin material, but may also include, on inside, a core material formed from a hollow square pipe made of steel, for example. In this case, the coupling piece 13 may be formed by insert molding, for example.

The leg parts 15 are attached to the coupling piece 13 that is positioned at lower ends of the column members 12. As shown in FIG. 4, the leg part 15 is formed from a combination of a bolt 15A and a nut 15B, and a protrusion length from the coupling piece 13 may be adjusted as appropriate. It is, of course, possible to form the leg parts 15 as casters to make the rack assembly 11 movable.

As shown in FIGS. 1 to 4, the four column members 12 are formed to have a same form. Each column member 12 extends in a vertical direction. The column member 12 includes the insertion parts 22 at both end portions in the axial direction A (at top and bottom).

Figure 5:
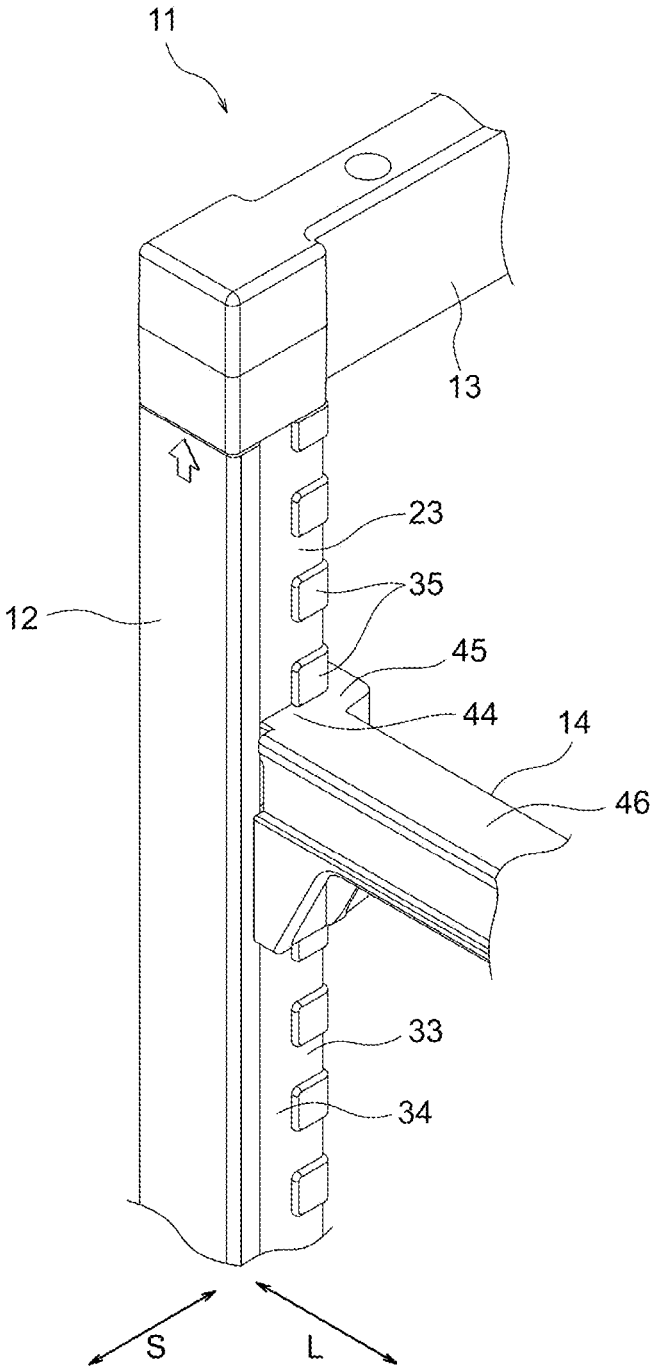
FIG. 5 is a perspective view showing, in an enlarged manner, a part of the rack assembly shown in FIG. 2.
Figure 6:
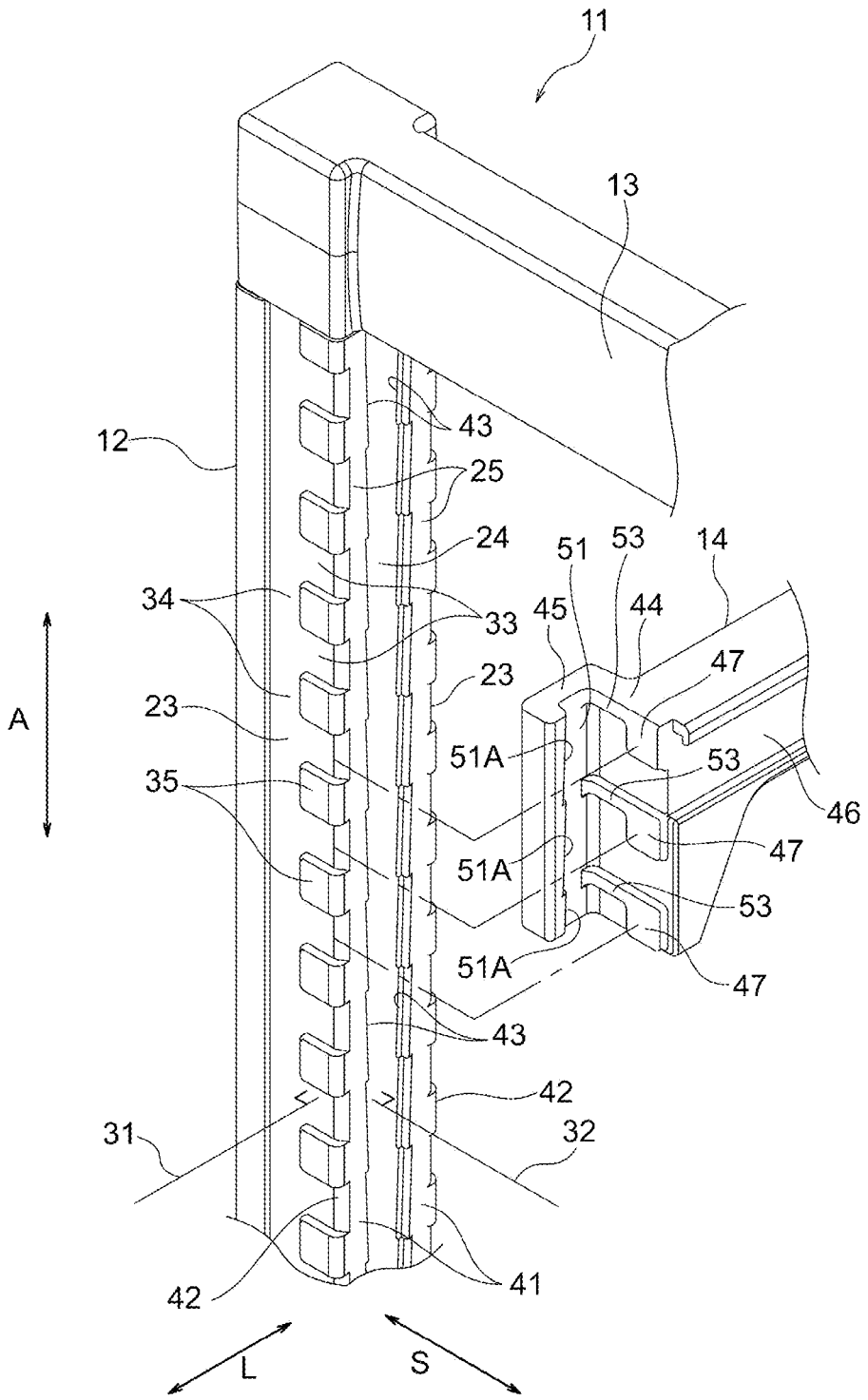
FIG. 6 is a perspective view showing, in relation to the rack assembly shown in FIG. 2, a state where the beam member is in air and is rotated 180 degrees such that a first part and a second part can be easily seen.

As shown in FIGS. 4 to 6, the column member 12 is formed into a rectangular columnar shape. The column member 12 is integrally formed by a resin material, but may also include, on inside, a core material formed from a hollow square pipe made of steel, for example. In this case, the column member 12 may be formed by insert molding, for example.

In FIG. 6, to facilitate understanding of the structure of the rack assembly 11, the beam member 14 is shown in the air at a position rotated by 180 degrees from an actual state.

The column member 12 includes a pair of first side surfaces 23 that face each other, a second side surface 24 that is adjacent to the first side surfaces 23, and a pair of rails 25 that protrude from the second side surface 24. A direction of a normal line 31 of the first side surface (a straight line direction orthogonal to the first side surface 23) extends along the long direction L of the rack assembly 11. A direction of a normal line 32 of the second side surface (a straight line direction orthogonal to the second side surface 24) extends along the short direction S of the rack assembly 11. The second side surface 24 is orthogonal to both of the pair of first side surfaces 23. The column member 12 is left-right symmetric.

Each of the pair of first side surfaces 23 includes a plurality of recessed portions 33 provided at regular intervals in the axial direction A, a plurality of second recessed portions 34 extending downward from deep parts of the plurality of recessed portions 33, and protrusions 35 having a substantially rectangular shape and provided at positions surrounded by the recessed portions 33 and the second recessed portions 34. The recessed portion 33 extends in the lateral direction, or in other words, in the direction of the normal line 32 of the second side surface (the direction orthogonal to the second side surface 24).

Each second recessed portion 34 is continuous to the deep part of the recessed portion 33 (an end portion of the recessed portion 33 opposite from the second side surface 24 side). The second recessed portion 34 extends in an up-down direction (the axial direction A of the column member 12). When the first side surface 23 is seen from front, the recessed portion 33 and the second recessed portion 34 form an L-shape. A lower end of the second recessed portion 34 is continuous to the deep part of the recessed portion 33 that is positioned immediately below. A shape of the lower end of the second recessed portion 34 is not limited to such a shape. For example, a ridge that extends in the direction of the normal line 32 of the second side surface from a lower end of the protrusion 35 may be provided in a manner separating the lower end of the second recessed portion 34 and the recessed portion 33 immediately below.

The protrusion 35 is formed to have a substantially square shape when the first side surface 23 is seen from the front. The protrusion 35 is formed to protrude several millimeters from a part forming the recessed portion 33 and the second recessed portion 34. The protrusion 35 is formed to mount on the first side surface 23 from a first guiding surface 42, described later, of the rail 25.

As shown in FIG. 6, the pair of rails 25 extend in the axial direction A of the column member 12. The pair of rails 25 are provided on both end portions of the second side surface 24 in a width direction. Each of the pair of rails 25 includes a top surface 41, one first guiding surface 42 provided adjacent to the top surface 41, on the first side surface 23 side, and a plurality of second guiding surfaces 43 provided adjacent to the top surface 41 and facing the first guiding surface 42.

The plurality of second guiding surfaces 43 are provided serially in the axial direction A of the column member 12 so as to correspond one-to-one with the plurality of recessed portions 33 provided at regular intervals in the axial direction A of the column member 12. Each of the plurality of second guiding surfaces 43 is sloped away from the first side surface 23, the closer to a bottom. Accordingly, when the beam member 14 is moved from a second position P2 to a third position P3, the second guiding surface 43 may perform positioning in such a way that the beam member 14 is pulled in a direction closer to the first side surface 23.

As shown in FIGS. 2 and 3, the plurality of beam members 14 are formed to have a same form. The beam member 14 extends in the lateral direction (horizontal direction). The beam member 14 is integrally formed by a resin material, but may also include, inside a beam main body 46 described later, a core material formed from a hollow square pipe made of steel, for example. In this case, the beam member 14 may be formed by insert molding, for example.

Figure 7:
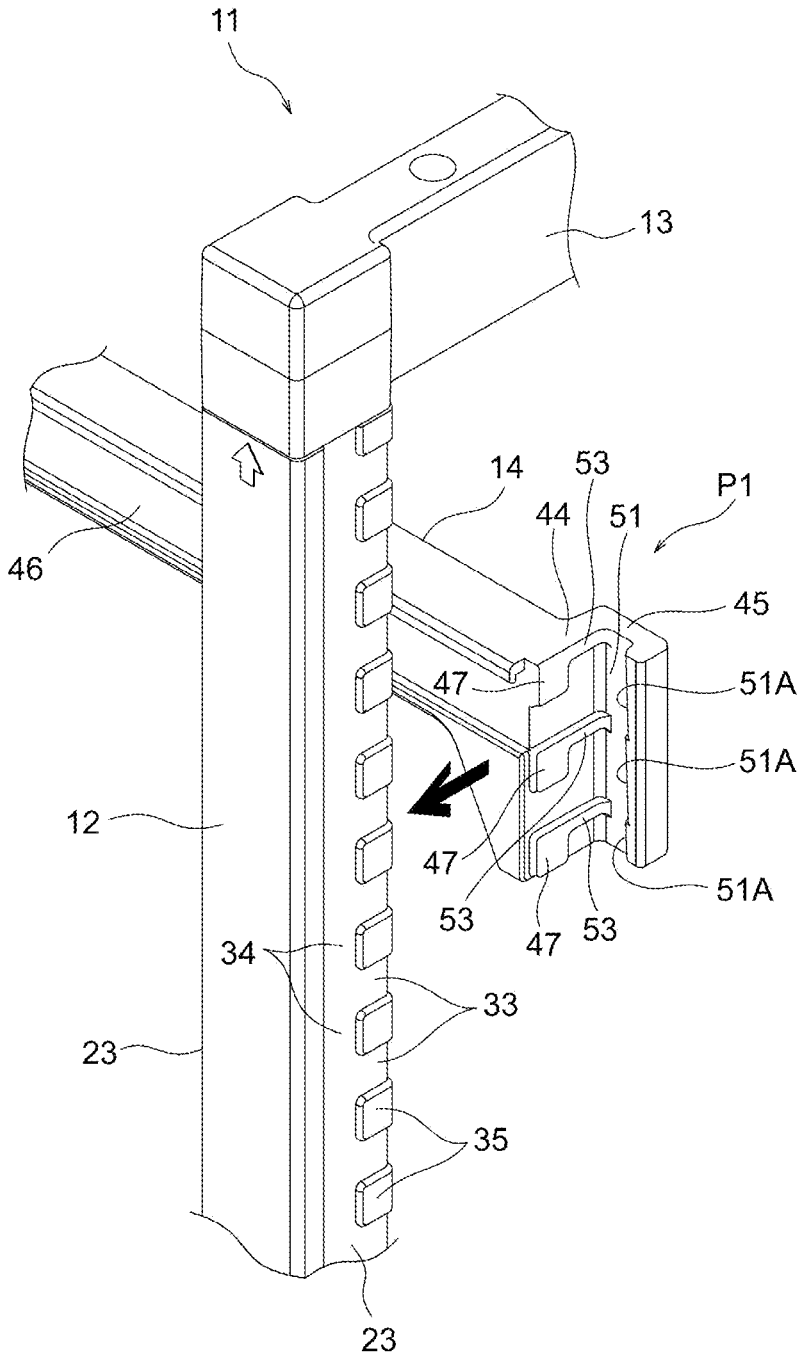
FIG. 7 is a perspective view showing a state where the rack assembly shown in FIG. 2 is at a first position at which the second part of the beam member faces a second side surface of a column member.

As shown in FIGS. 6 and 7, the beam member 14 includes a first part 44 that faces the first side surface 23, a second part 45 that faces the second side surface 24, and the beam main body 46 that extends from the first part 44, in the direction of the normal line 31 of the first side surface. The first part 44 and the second part 45 form an L-shape when seen in the axial direction A of the column member 12. The beam main body 46 is formed into a rectangular columnar shape that has a vertically long, rectangular cross-section.

The first part 44 includes a plurality of protruding portions 47, and a plurality of hook portions 53 that extend in the lateral direction (horizontal direction) from upper ends of the plurality of protruding portions 47, respectively. For example, the first part 44 includes three protruding portions 47 and three hook portions 53. Each protruding portion 47 is substantially square when the first part 44 is seen from front. The hook portion 53 is integrally formed with the protruding portion 47. The protruding portion 47 and the hook portion 53 are formed to protrude several millimeters from other parts of the first part 44. An interval between the plurality of protruding portions 47 is substantially the same as an interval between the recessed portions 33.

Figure 12:
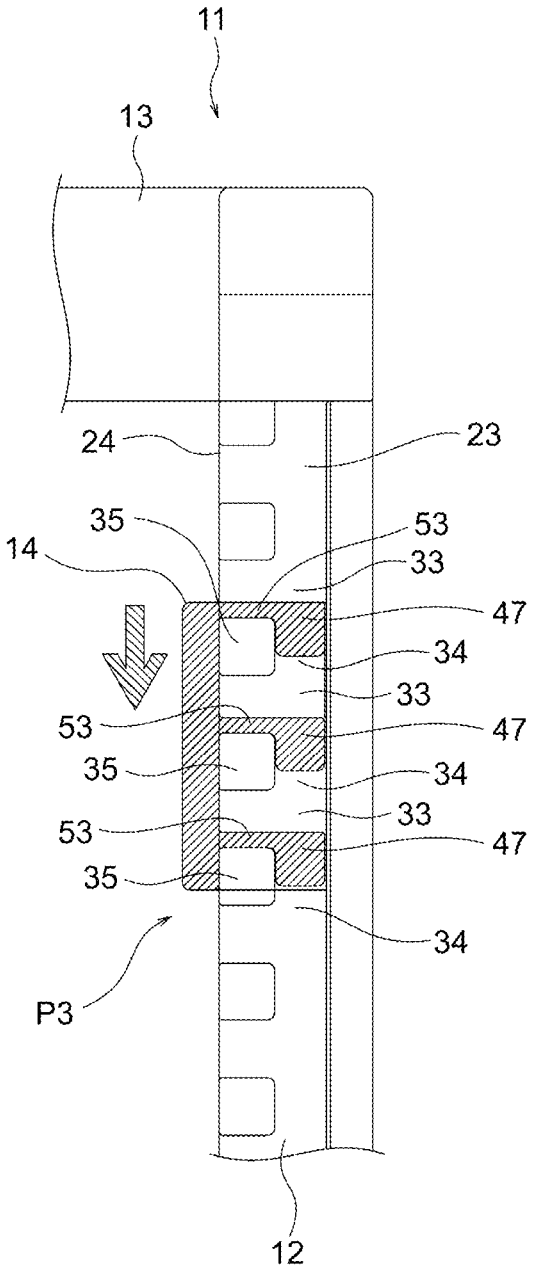
FIG. 12 is a perspective view showing a state where the beam member is moved relative to the rack assembly shown in FIG. 11 to the third position below under its own weight, and the protruding portion is fitted down into a second recessed portion.

As shown in FIG. 12, the hook portion 53 includes a part to which the protrusion 35 of the column member 12 is hooked when the beam member 14 is at the third position P3.

Figure 13:
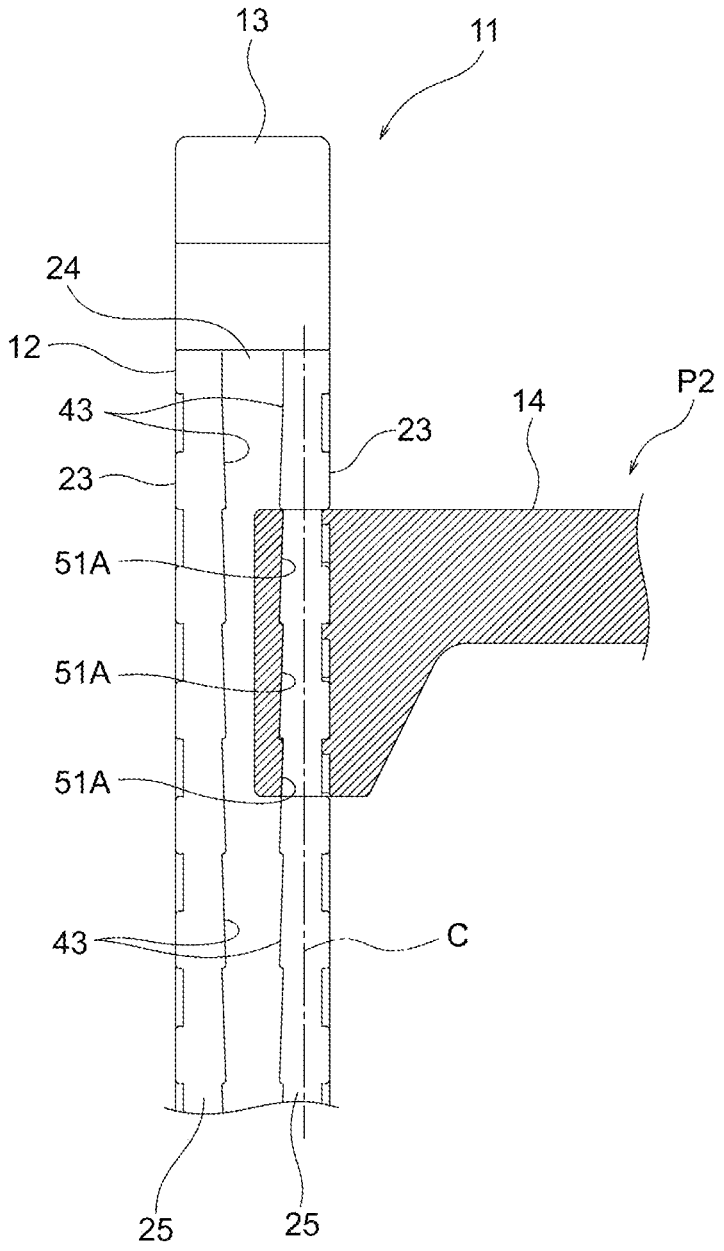
FIG. 13 is a cross-sectional view showing a state where the beam member is moved relative to the rack assembly shown in FIG. 10 in the normal direction of the second side surface and is at the second position at which the beam member is fixed to the column member by having the protruding portion inserted into one of the plurality of recessed portions.

As shown in FIG. 6, the second part 45 is plate-shaped. The second part 45 includes a saddle part 51 that is saddle-shaped (cross-sectionally arc-shaped). The saddle part 51 extends in the axial direction A of the column member 12, and may be mounted on the rail 25. The saddle part 51 includes a plurality of guided surfaces 51A that are guided by the second guiding surfaces 43. As shown in FIGS. 6, 7, 13, and the like, the guided surface 51A is sloped to be closer to the rail 25 (center axis C of the rail 25), the closer to the top.

Next, an assembly method and effects of the rack assembly 11 of the present embodiment will be described. First, as shown in FIG. 4, a worker forms a frame-shaped frame 52 by coupling a pair of column members 12 by a pair of coupling pieces 13 in the short direction S. At this time, the worker fixes upper ends of the column members 12 by the coupling piece 13 on an upper side, and fixes lower ends of the column members 12 by the coupling piece 13 on a lower side. Moreover, the leg parts 15 are attached to the coupling piece 13 on the lower side. Two frames 52 are formed in this manner.

Figure 10:
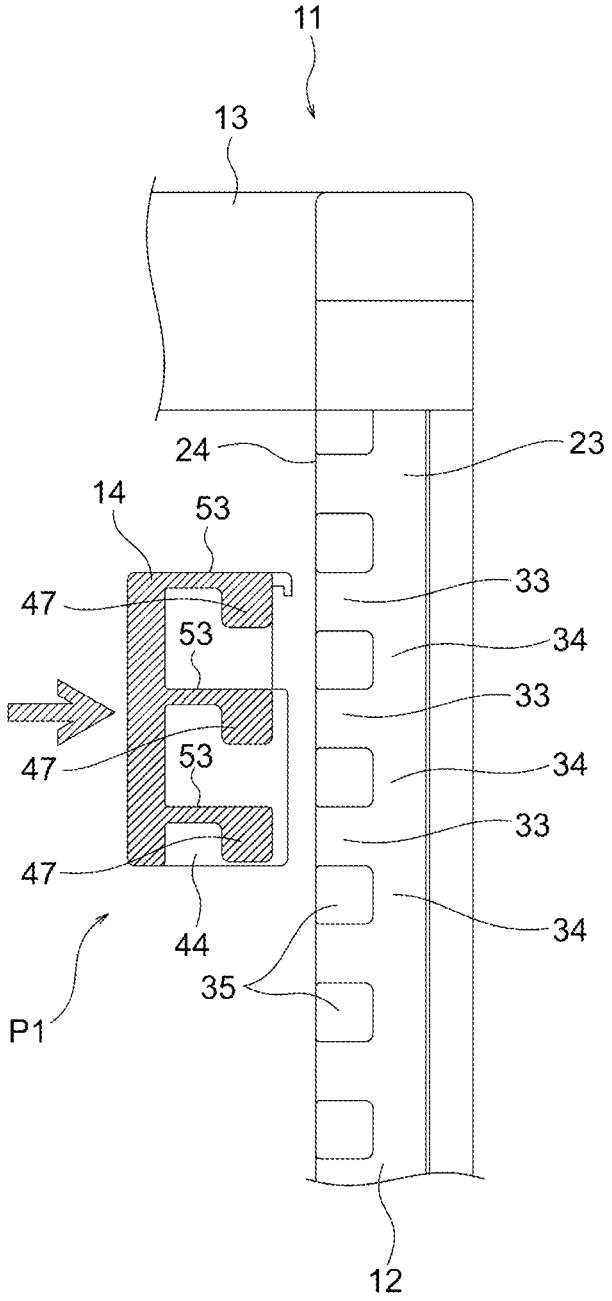
FIG. 10 is a cross-sectional view showing a state where the rack assembly shown in FIG. 2 is at the first position at which the second part of the beam member faces the second side surface of the column member.

As shown in FIGS. 2, 3, 6, and 7, the worker places the beam member 14 between the column members 12 that are adjacent to each other in the long direction L. At this time, as shown in FIGS. 7 and 10, the worker places the beam member 14 at the first position P1 at which the second part 45 faces the second side surface 24, in a state where the beam member 14 is separated from the column member 12.

Figure 8:
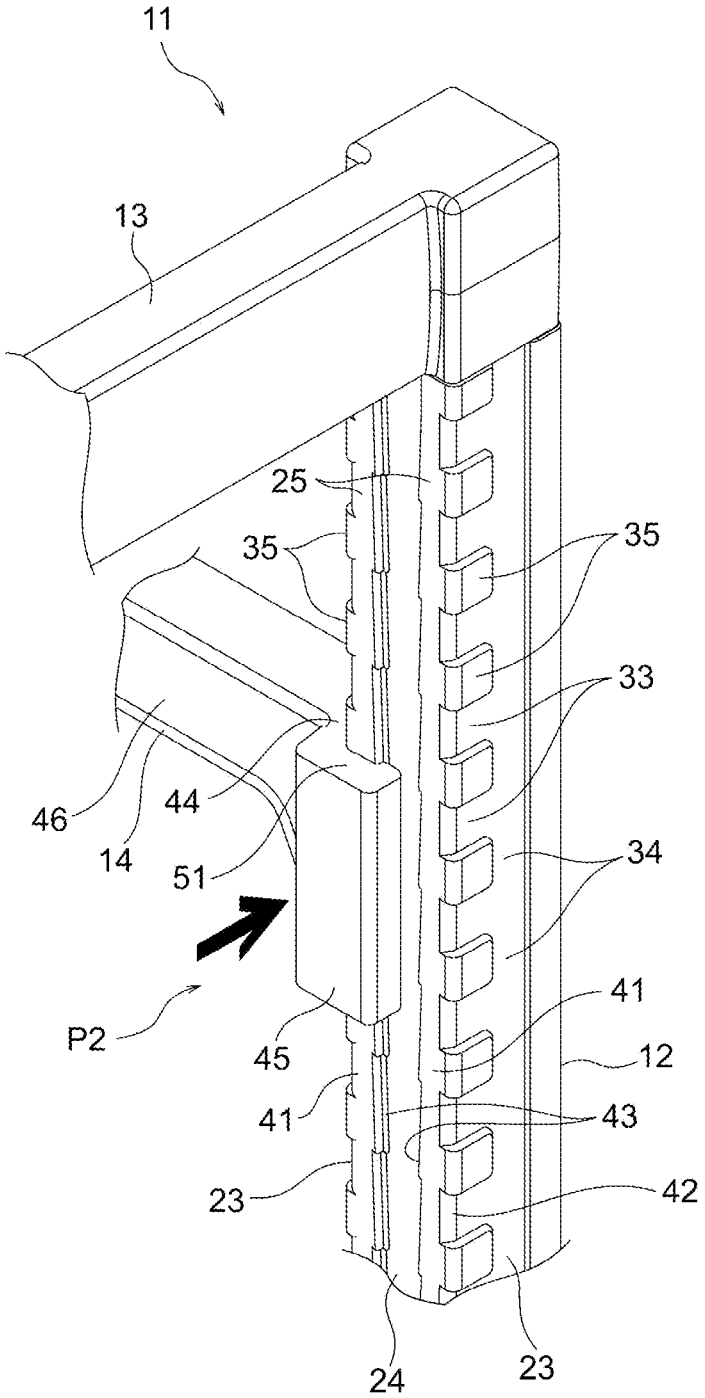
FIG. 8 is a perspective view showing a state where the beam member is moved relative to the rack assembly shown in FIG. 7 in a normal direction of the second side surface and is at a second position at which the beam member is fixed to the column member by having a protruding portion inserted into one of a plurality of recessed portions.
Figure 11:
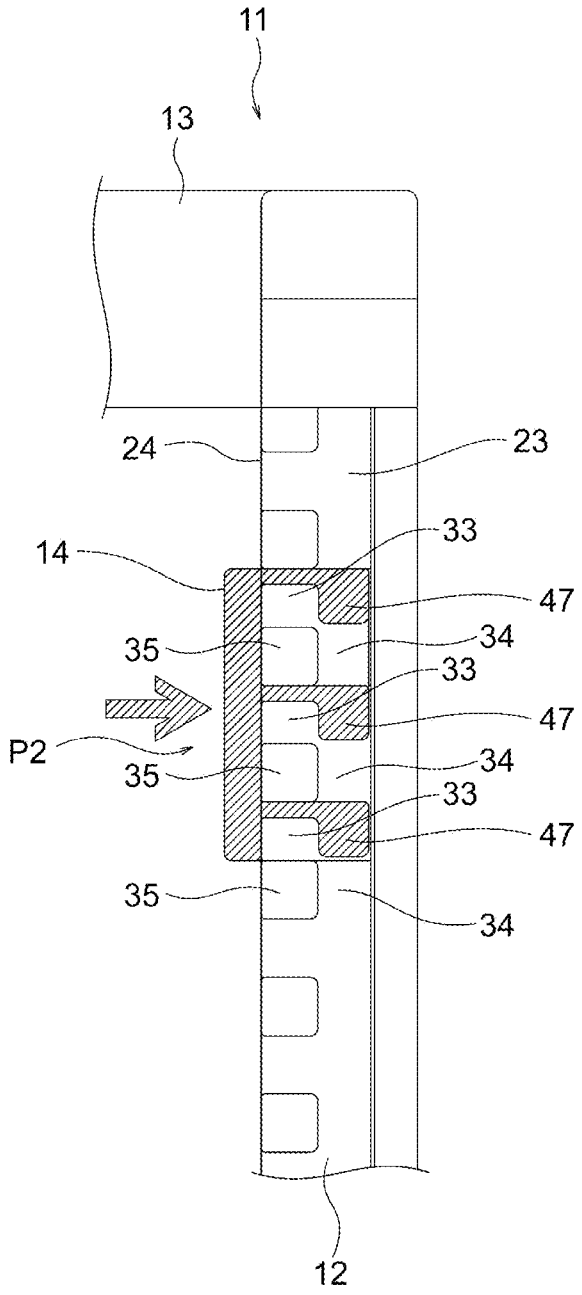
FIG. 11 is a cross-sectional view showing a state where the beam member is moved relative to the rack assembly shown in FIG. 10 in the normal direction of the second side surface and is at the second position at which the beam member is fixed to the column member by having the protruding portion inserted into one of the plurality of recessed portions.

As shown in FIGS. 7 and 8, the worker moves the beam member 14 in the direction of the normal line 32 of the second side surface (substantially horizontal direction) from the first position P1, and places the beam member 14 at the second position P2 to be fixed to the column member 12 by inserting the protruding portion 47 into one of the plurality of recessed portions 33. At this time, the saddle part 51 of the second part 45 of the beam member 14 is mounted on the rail 25 of the column member 12. At this time, as shown in FIGS. 10 and 11, the three protruding portions 47 of the beam member 14 are inserted into the three recessed portions 33 of the column member 12. The worker inserts the protruding portions 47 of the beam member 14 into deepest parts of the recessed portions 33 of the column member 12.

Figure 9:
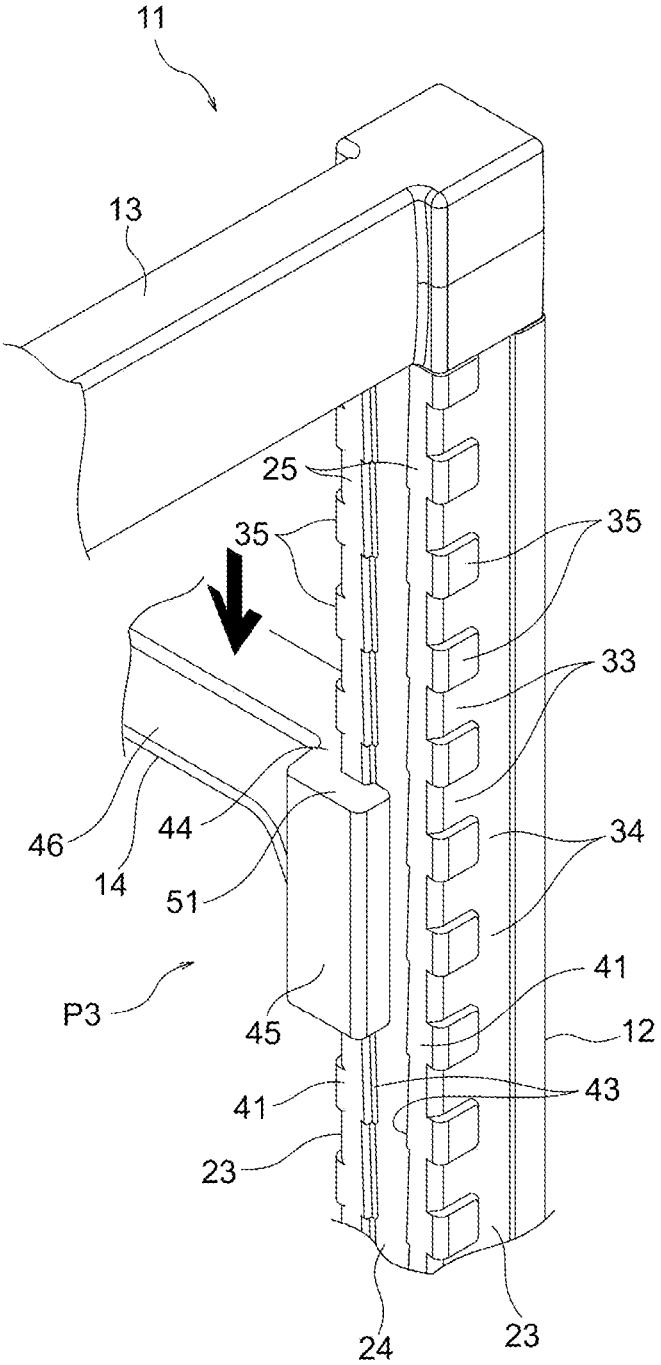
FIG. 9 is a perspective view showing a state where the beam member is moved relative to the rack assembly shown in FIG. 7 to a third position below under its own weight.

As shown in FIG. 9, the beam member 14 that is inserted into the deepest parts of the recessed portions 33 of the column member 12 may be fitted downward by being pushed down with a hand or by being hit with a tool such as a hammer from above. At this time, as shown in FIGS. 11 and 12, the protruding portion 47 of the beam member 14 moves to be fitted downward from the deep part of the recessed portion 33 of the column member 12 into the second recessed portion 34. The beam member 14 thus moves from the second position P2 to the third position P3. Additionally, in the present embodiment, the beam member 14 is moved from the second position P2 to the third position P3 by being pushed in with a hand or a tool, but such a mode is not restrictive, and the beam member 14 may move from the second position P2 to the third position P3 under its own weight.

At this time, as shown in FIG. 12, the protruding portion 47 that is fitted down into the second recessed portion 34 engages with the protrusion 35 of the column member 12. The beam member 14 is thus locked with the column member 12 when the beam member 14 is at the third position P3, and the beam member 14 is not detached from the column member 12 in such a state. That is, when moment of force from the second side surface 24 toward the first side surface 23 is applied to the beam member 14, the saddle part 51 of the second part 45 is hooked to the rail 25, and the beam member 14 is prevented from being detached from the column member 12. When moment of force from the first side surface 23 toward the second side surface 24 is applied to the beam member 14, the protruding portion 47 fitted down in the second recessed portion 34 is hooked to the protrusion 35, and the beam member 14 is prevented from being detached from the column member 12.

In this manner, with the rack assembly 11 of the present embodiment, the beam member 14 is locked by being moved from the second position P2 to the third position P3, and thus, a separate fixing component for locking the beam member 14 is not necessary. Accordingly, the number of components is reduced, and an overall structure of the rack assembly 11 is simplified. Furthermore, even in a case where vibration or the like is applied to the rack assembly 11 at the time of movement of the rack assembly 11, unintentional detachment of the beam member 14 from the column member 12 may be prevented.

At the time of movement of the beam member 14 from the second position P2 to the third position P3, the saddle part 51 of the second part 45 of the beam member 14 is able to slide and move along the rail 25 of the column member 12. Accordingly, orientation of the beam member 14 moving from the second position P2 to the third position P3 becomes stable, and the beam member 14 is not detached from the column member 12 during movement.

Figure 14:
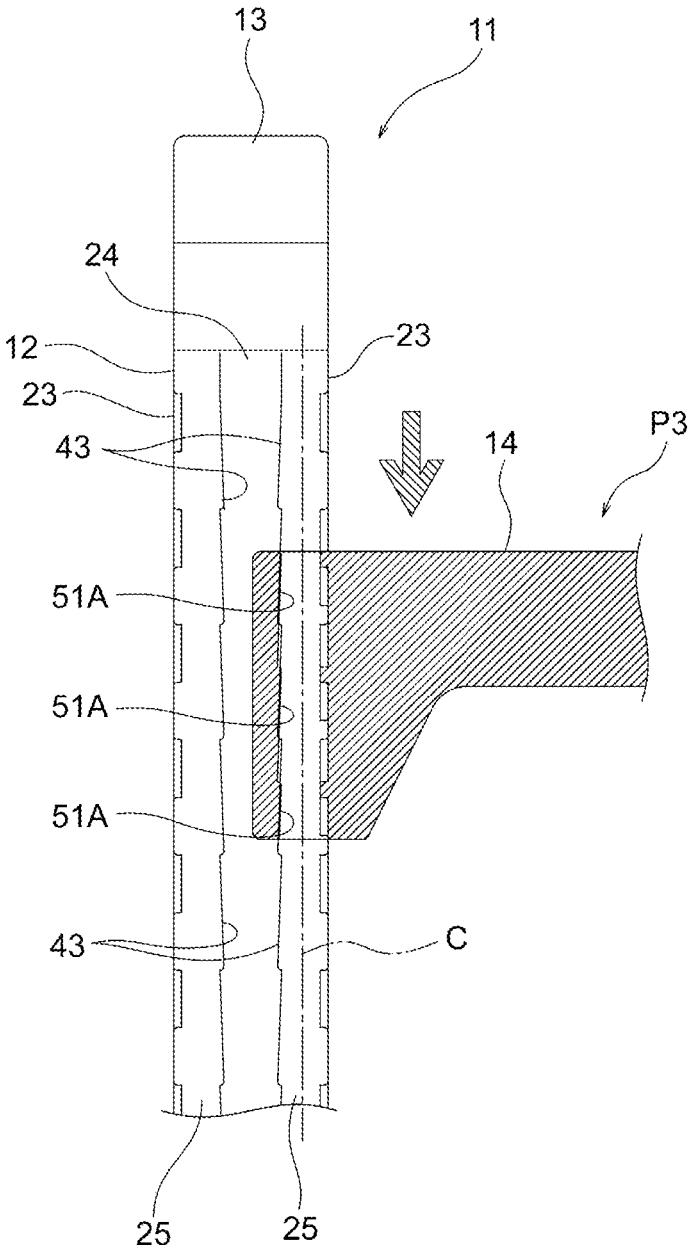
FIG. 14 is a cross-sectional view showing a state where the beam member is moved relative to the rack assembly shown in FIG. 13 to the third position below under its own weight, where a guided surface of the beam member is guided by a second guiding surface of a rail and the beam member is pressed against a first side surface due to a wedge effect.

At the time of movement from the second position P2 to the third position P3, the beam member 14 is positioned relative to the column member 12 and is firmly fixed to the column member 12 due to a wedge effect applied between the second guiding surface 43 of the rail 25 and the guided surface 51A of the saddle part 51. Positioning of the beam member 14 is performed relative to the long direction L of the rack assembly 11. That is, as shown in FIGS. 13 and 14, when the beam member 14 is moved from the second position P2 to the third position P3, the guided surface 51A of the beam member 14 is guided by the second guiding surface 43 of the rail 25.

At this time, because the second guiding surface 43 is separated from the first side surface 23, the closer to the bottom, and the guided surface 51A is sloped closer to the rail 25 (the center axis C of the rail 25), the closer to the top, the wedge effect is applied and the beam member 14 is pulled close (pushed against) to the first side surface 23 of the column member 12. The beam member 14 is thus firmly fixed to the column member 12. Furthermore, rattling of the beam member 14 is prevented, and the beam member 14 is appropriately positioned in the long direction L of the rack assembly 11. Moreover, the beam member 14 is prevented from being detached from the column member 12 when not intended by a user.

Additionally, in the present embodiment, the beam member 14 is appropriately positioned only in the long direction L where influence of dimensions is great and a shift in position is easily seen. Positioning is not particularly performed in relation to the short direction S where influence of dimensions is small and a shift in position is not easily seen.

After the beam member 14 is installed at a predetermined installation height as shown in FIG. 2, the shelf panel 16 is installed to extend between a pair of beam members 14 as shown in FIG. 15. The shelf panel 16 can be easily attached to a pair of beam members 14 by positioning the pair of hook portions 17 with respect to the beam members 14 and placing the same on the beam members 14. When the shelf panel 16 is installed on all the beam members 14, the state shown in FIG. 1 is reached and assembly of the rack assembly 11 is completed. Procedures described above may be performed in a reversed manner to disassemble the rack assembly 11.

In a case where the installation height of the shelf panel 16 is desired to be changed, the installation height of the shelf panel 16 may be very easily changed by replacing a position of the beam member 14 on the column member 12 as appropriate in a state where the shelf panel 16 is removed.

Figure 16:
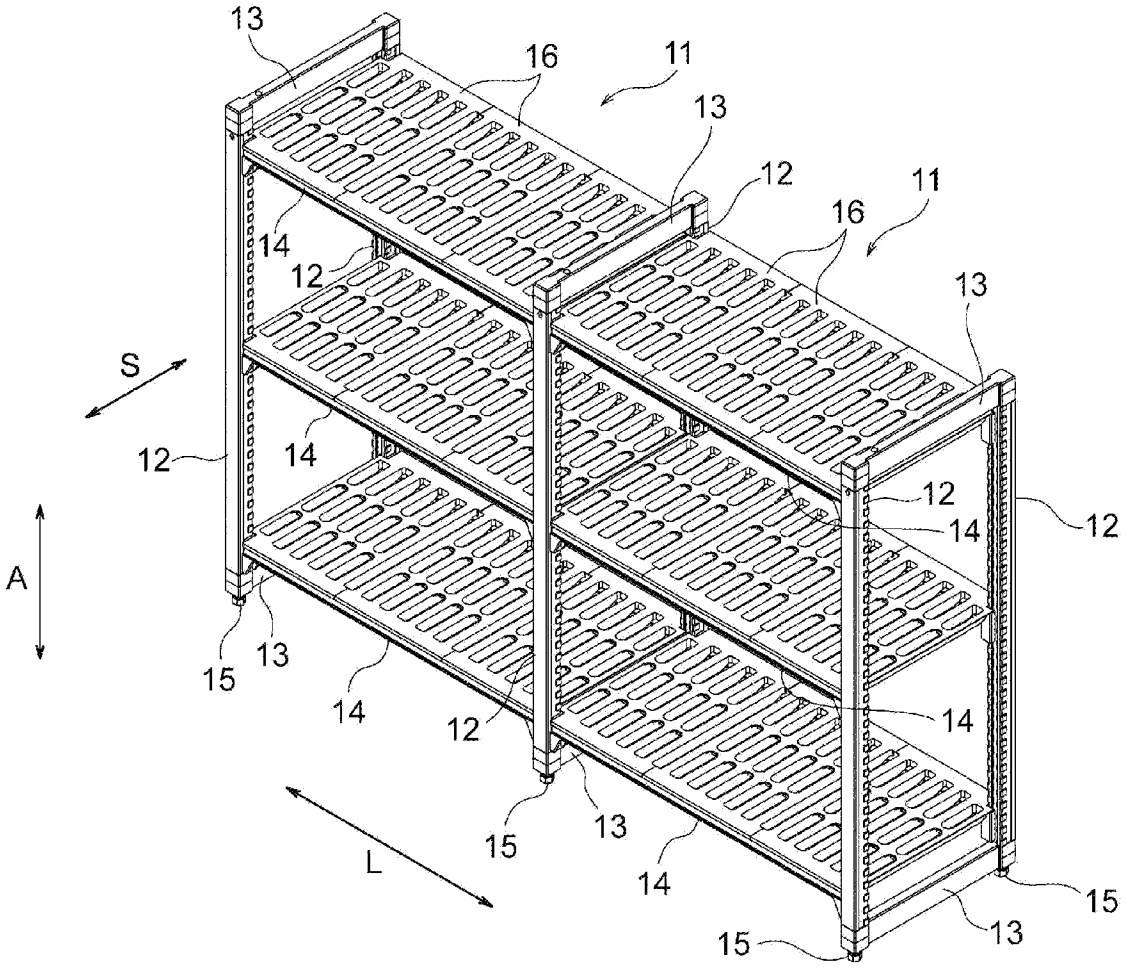
FIG. 16 is a perspective view showing a rack assembly of a modification of the present embodiment.

FIG. 16 shows a modification of the rack assembly 11. With the rack assembly 11 of the modification, one column member 12 that is left-right symmetric as described above serves as a column for two rack assemblies 11. That is, of the column member 12 that is positioned in middle in the drawing, the first side surface 23 positioned on a left side and the rail 25 positioned on the left side are used to support the rack assembly 11 on the left side. In the same manner, of the column member 12 that is positioned in the middle in the drawing, the first side surface 23 positioned on a right side and the rail 25 positioned on the right side are used to support the rack assembly 11 on the right side. Two rack assemblies 11 may thus be coupled and used. Moreover, the number of rack assemblies 11 to be coupled is not limited to two, and any number of rack assemblies 11 may be coupled as long as there is space.

According to the present embodiment, the following can be said. The rack assembly 11 includes the column member 12 including the first side surface 23 that includes a plurality of recessed portions 33 provided at a regular interval in the axial direction A, and the second side surface 24 that is adjacent to the first side surface 23, and the beam member 14 including the first part 44 that includes the protruding portion 47 and that faces the first side surface 23, and the second part 45 that is provided adjacent to the first part 44 and that faces the second side surface 24, where each of the plurality of recessed portions 33 extends in the direction of the normal line 32 of the second side surface, and the beam member 14 is movable between the first position P1 at which the second part 45 faces the second side surface 24 in a state where the beam member 14 is separated from the column member 12, and the second position P2 at which the beam member 14 is fixed to the column member 12 by being moved in the direction of the normal line 32 of the second side surface from the first position P1 and by having the protruding portion 47 inserted into one of the plurality of recessed portions 33.

According to such a structure, the beam member 14 may be fixed to the column member 12 with one touch by a simple structure of inserting the protruding portion 47 in the first recessed portion 33. Accordingly, a task of changing the installation height of the beam member 14 may be very easily performed. Furthermore, because the beam member 14 may be fixed by movement in the direction of the normal line 32 of the second side surface, the recessed portions 33 may be installed at relatively small intervals, and thus, the installation height of the beam member 14 may be finely adjusted. Moreover, thanks to a simple structure of combining the protruding portion 47 and the recessed portion 33, cleaning can be easily performed, and use in a food factory and the like is desirable.

In this case, the first side surface 23 includes a plurality of second recessed portions 34, each of the plurality of second recessed portions 34 extending downward from the deep part of each of the plurality of recessed portions 33, and the protruding portion 47 is allowed to be fitted down in the second recessed portion 34 at the second position P2 to allow the beam member 14 to move from the second position P2 to the third position P3 lower than the second position P2.

According to such a structure, thanks to a structure where the protruding portion 47 is fitted down in the second recessed portion 34 and the beam member 14 is moved from the second position P2 to the third position P3, an inconvenience that the beam member 14 is unintentionally detached from the column member 12 may be prevented.

In this case, the column member 12 includes the rail 25 that protrudes from the second side surface 24 and extends in the axial direction A, and the second part 45 includes the saddle part 51 extending in the axial direction A and having a saddle shape that allows mounting on the rail 25, the saddle part 51 being capable of sliding and moving along the rail 25 at a time when the beam member 14 is moved between the second position P2 and the third position P3.

According to such a structure, because the second part 45 includes the saddle part 51, the beam member 14 may be prevented from being detached from the column member 12 at a time when the beam member 14 moves from the second position P2 to the third position P3.

The first side surface 23 includes the protrusion 35 at a position surrounded by the recessed portion 33 and the second recessed portion 34, and when the beam member 14 is at the third position P3, the protruding portion 47 fitted down in the second recessed portion 34 engages with the protrusion 35.

According to such a structure, the beam member 14 may be prevented from being detached from the column member 12 when at the third position P3. That is, when moment of force from the second side surface 24 toward the first side surface 23 is applied to the beam member 14, the saddle part 51 of the second part 45 is hooked to the rail 25, and the beam member 14 is prevented from being detached from the column member 12. When moment of force from the first side surface 23 toward the second side surface 24 is applied to the beam member 14, the protruding portion 47 fitted down in the second recessed portion 34 is hooked to the protrusion 35, and the beam member 14 is prevented from being detached from the column member 12.

The rail 25 includes the top surface 41, the first guiding surface 42 provided adjacent to the top surface 41, on a side of the first side surface 23, and the second guiding surface 43 provided adjacent to the top surface 41 in a manner facing the first guiding surface 42, the second guiding surface 43 being sloped away from the first side surface 23, the closer to a bottom.

According to such a structure, when the beam member 14 is moved from the second position P2 to the third position P3, the second guiding surface 43 functions as a wedge, and the beam member 14 is pulled closer to the first side surface 23 of the column member 12.

Accordingly, the beam member 14 is positioned relative to the column member 12, and rattling of the beam member 14 may be prevented. Furthermore, due to the wedge effect, the beam member 14 may be firmly fixed to the column member 12. Moreover, the beam member 14 may be prevented from being detached from the column member 12 when not intended by a user.

The saddle part 51 includes the guided surface 51A that is guided by the second guiding surface 43, the guided surface 51A being sloped to be closer to the rail 25, the closer to a top.

According to such a structure, when the beam member 14 is moved from the second position P2 to the third position P3, the guided surface 51A functions as a wedge, in addition to the second guiding surface 43, and the beam member 14 is pulled closer to the first side surface 23 of the column member 12. Accordingly, the beam member 14 may be positioned relative to the column member 12, and rattling of the beam member 14 may be prevented. Moreover, due to the wedge effect described above being enhanced, the beam member 14 may be more firmly fixed to the column member 12.

The beam member 14 includes the beam main body 46 that extends in the direction of the normal line 31 of the first side surface, and the direction of the normal line 31 of the first side surface matches the long direction L.

According to such a structure, the beam member 14 may be positioned in the long direction L of the rack assembly 11. Therefore, according to the structure described above, the beam member 14 may be positioned relative to the column member 12 in relation to the long direction L of the rack assembly 11 where a high standard of positioning is generally required. By contrast, in the present application, not much importance is placed on positioning in the short direction S intersecting the long direction L because influence of a shift in position is smaller for the short direction S than for the long direction L due to a length in the short direction S being small.

The column member 12 includes, at a position facing the first side surface 23 and adjacent to the second side surface 24, the first side surface 23 that is additionally provided. According to such a structure, the column member 12 may be formed into a left-right symmetric shape, and the beam member 14 may be attached to both left and right sides of the column member 12. Accordingly, at a time of disposing two rack assemblies 11 next to each other, one column member 12 may be shared by the two rack assemblies 11, and the number of column members 12 may be reduced, and a cost of introducing the rack assemblies 11 to a factory or a shop may be reduced.

Moreover, by serially coupling a plurality of rack assemblies 11, stiffness of the rack assemblies 11 may be increased, and more stable rack assemblies 11 may be achieved.

The embodiment described above may be implemented with various additional changes and modifications. It is naturally possible to configure one invention by combining the different embodiments described above as appropriate.

REFERENCE SIGNS LIST

11 rack assembly
12 column member
14 beam member
23 first side surface
24 second side surface
25 rail
C center axis
31 normal line of first side surface
32 normal line of second side surface
33 recessed portion
34 second recessed portion
35 protrusion
41 top surface
42 first guiding surface
43 second guiding surface
P1 first position
P2 second position
P3 third position
44 first part
45 second part
46 beam main body
47 protruding portion
51 saddle part
51A guided surface
52 frame
L long direction
S short direction
A axial direction

The invention claimed is:

1. A rack assembly comprising:

a plurality of column members, each of the plurality of column members including a first side surface that includes a plurality of recessed portions provided at a regular interval in an axial direction, and a second side surface that is adjacent to the first side surface; and a plurality of beam members, each of the plurality of beam members including a first part that includes a protruding portion and that faces the first side surface, and a second part that is provided adjacent to the first part and that faces the second side surface, wherein each of the plurality of recessed portions extends in a normal direction of the second side surface, and each of the plurality of beam members is movable between a first position at which the second part faces the second side surface in a state where each of the plurality of beam members is separated from each of the plurality of column members, and a second position at which each of the plurality of beam members is fixed to each of the plurality of column members by being moved in the normal direction of the second side surface from the first position and by having the protruding portion inserted into one of the plurality of recessed portions, wherein the first side surface includes a plurality of second recessed portions, each of the plurality of second recessed portions extending downward from a part of each of the plurality of recessed portions, and the protruding portion is configured to be fitted down in the second recessed portion at the second position to allow each of the plurality of beam members to move from the second position to a third position lower than the second position, and wherein each of the plurality of column members includes a rail that protrudes from the second side surface and extends in the axial direction, and the second part includes a saddle part extending in the axial direction and having a saddle shape that is configured to be mounted on the rail, the saddle part being capable of sliding and moving along the rail when each of the plurality of beam members is moved between the second position and the third position, and wherein the rail includes a top surface, a first guiding surface provided adjacent to the top surface, on a side of the first side surface, and a second guiding surface provided adjacent to the top surface in a manner facing the first guiding surface, the second guiding surface being sloped away from the first side surface.

2. The rack assembly according to claim 1, wherein the first side surface includes a protrusion at a position surrounded by the recessed portion and the second recessed portion, and when each of the plurality of beam members is at the third position, the protruding portion fitted down in the second recessed portion engages with the protrusion.

3. The rack assembly according to claim 1, wherein the saddle part includes a guided surface that is guided by the second guiding surface, the guided surface being sloped to be closer to the rail.

4. The rack assembly according to claim 1, wherein each of the plurality of beam members includes a beam main body that extends in a normal direction of the first side surface.

5. The rack assembly according to claim 1, wherein each of the plurality of column members is formed into a left-right symmetric shape.

* * * * *